US010117039B2

(12) United States Patent
Chon et al.

(10) Patent No.: US 10,117,039 B2
(45) Date of Patent: Oct. 30, 2018

(54) AUDIO APPARATUS AND METHOD OF CONVERTING AUDIO SIGNAL THEREOF

(71) Applicant: SAMSUNG ELECTRONICS CO., LTD., Suwon-si (KR)

(72) Inventors: Sang-bae Chon, Suwon-si (KR); Sun-min Kim, Suwon-si (KR); Jeong-su Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 903 days.

(21) Appl. No.: 13/853,773

(22) Filed: Mar. 29, 2013

(65) Prior Publication Data

US 2013/0259236 A1 Oct. 3, 2013

Related U.S. Application Data

(60) Provisional application No. 61/618,047, filed on Mar. 30, 2012.

(30) Foreign Application Priority Data

Dec. 17, 2012 (KR) ..... 10-2012-0147621

(51) Int. Cl.
*H04S 3/00* (2006.01)
*H04S 7/00* (2006.01)

(52) U.S. Cl.
CPC ..... *H04S 3/00* (2013.01); *H04S 3/002* (2013.01); *H04S 7/302* (2013.01); *H04S 2400/11* (2013.01)

(58) Field of Classification Search
CPC ..... H04S 3/00; H04S 3/002; H04S 2400/11; H04S 7/302
See application file for complete search history.

(56) References Cited

U.S. PATENT DOCUMENTS 8,170,222 B2 5/2012 Dunko
2008/0232601 A1 9/2008 Pulkki
(Continued)

FOREIGN PATENT DOCUMENTS

CN 101658052 A 2/2010
CN 101999067 A 3/2011
(Continued)

OTHER PUBLICATIONS

Communication dated Jul. 26, 2013 issued by the International Searching Authority in counterpart International Application No. PCT/KR2013/002634 (PCT/ISA/210).
(Continued)

*Primary Examiner* — Ping Lee
(74) *Attorney, Agent, or Firm* — Sughrue Mion, PLLC

(57) ABSTRACT

An audio apparatus and a method of converting an audio signal are provided. The method includes: receiving a first audio signal including a plurality of channels; comparing audio signals of the plurality of channels to estimate a source position of the first audio signal; localizing a source of the first audio signal toward a three-dimensional (3D) position having an elevation component based on the estimated source position; converting the first audio signal into a second audio signal including the plurality of channels and at least one channel having, based on the localized source, a different elevation from the plurality of channels; and outputting the second audio signal.

34 Claims, 8 Drawing Sheets

(56) References Cited

U.S. PATENT DOCUMENTS

| | | | | |
|---|---|---|---|---|
| 2008/0304670 | A1 | 12/2008 | Breebaart | |
| 2009/0262946 | A1 | 10/2009 | Dunko | |
| 2011/0249819 | A1* | 10/2011 | Davis | H04S 5/005 381/17 |
| 2011/0252950 | A1 | 10/2011 | Trivi et al. | |
| 2011/0286602 | A1 | 11/2011 | Yuen et al. | |
| 2012/0155679 | A1* | 6/2012 | Van Dongen | H04S 7/302 381/304 |
| 2015/0146873 | A1* | 5/2015 | Chabanne et al. | 381/1 |

FOREIGN PATENT DOCUMENTS

| | | | |
|---|---|---|---|
| CN | 102273233 | A | 12/2011 |
| EP | 2398257 | A2 | 12/2011 |
| KR | 10-2007-0111962 | A | 11/2007 |
| WO | 2008113427 | A1 | 9/2008 |
| WO | 2010080451 | A1 | 7/2010 |
| WO | 2011020157 | A1 | 2/2011 |

OTHER PUBLICATIONS

Communication dated Jul. 26, 2013 issued by the International Searching Authority in counterpart International Application No. PCT/KR2013/002634 (PCT/ISA/237).

Communication dated Sep. 21, 2015, issued by the European Patent Office in counterpart European Application No. 13161624.5.

Communication dated Jan. 20, 2016, from the State Intellectual Property Office of People's Republic of China in counterpart Chinese Application No. 201310109417.7.

Communication dated Oct. 8, 2016, issued by the State Intellectual Property Office of P.R. China in counterpart Chinese Application No. 201310109417.7.

Communication dated Jul. 19, 2017, issued by the European Patent Office in counterpart European Application No. 13161624.5.

* cited by examiner

AUDIO APPARATUS AND METHOD OF CONVERTING AUDIO SIGNAL THEREOF

CROSS-REFERENCE TO RELATED APPLICATIONS

This application claims priority from Korean Patent Application No. 10-2012-0147621, filed on Dec. 17, 2012 in the Korean Intellectual Property Office, and claims the benefit of U.S. Provisional Application No. 61/618,047, filed on Mar. 30, 2012 in the U.S. Patent and Trademark Office, the disclosures of which are incorporated herein by reference in their entireties.

BACKGROUND

1. Field

Aspects of exemplary embodiments relate to an audio apparatus and a method of converting an audio signal thereof, and more particularly, to providing an audio apparatus for converting a two-dimensional (2D) audio signal into a three-dimensional (3D) audio signal having an elevation component and a method of converting an audio signal thereof.

2. Description of the Related Art

Audio signals of various channels (e.g., a 2.1 channel audio signal, a 5.1 channel audio signal, etc.) exist to provide an audio signal to a user. An audio signal, such as a 2.1 channel audio signal or a 5.1 channel audio signal, forms a two-dimensional (2D) sound field based on the same height as ears of a user to be provided to the user.

A three-dimensional (3D) audio having an elevation component has been developed to prepare for an upcoming Ultra High Definition TV (UHDTV) era simultaneously with the growth of the 3D image market. For example, an audio signal having various elevation sound fields such as a 22.2 channel audio signal has been developed. In particular, the 22.2 channel audio signal has 10 audio channels to generate a sound field at the same height as ears of a human, 9 audio channels to generate a sound field above the ears of the human, and 3 audio channels and 2 low sound channels to generate a sound field below the ears of the human. Due to such a 22.2 channel audio signal, an audio apparatus reproduces a 3D surround sound field.

However, most audio contents are audio signals which form 2D sound fields like a 2.1 channel audio signal or a 5.1 channel audio signal.

Accordingly, a method of converting an audio signal forming a 2D sound field into a 3D audio signal is required to provide a 3D surround sound field having a 3D effect to a user.

SUMMARY

Exemplary embodiments address at least the above problems and/or disadvantages and other disadvantages not described above. Also, exemplary embodiments are not required to overcome the disadvantages described above, and an exemplary embodiment may not overcome any of the problems described above.

Exemplary embodiments provide an audio apparatus for estimating a source of an audio signal having a plurality of channels and putting a source of a received audio signal in a three-dimensional (3D) position having an elevation component based on a position of the estimated source to provide a 3D audio signal having an elevation component to a user, and a method of converting an audio signal thereof.

According to an aspect of an exemplary embodiment, there is provided a method of converting an audio signal of an audio apparatus, the method including: receiving a first audio signal including a plurality of channels; comparing audio signals of the plurality of channels to estimate a source position of the first audio signal; localizing a source of the first audio signal toward a 3D position having an elevation component based on the estimated source position; converting the first audio signal into a second audio signal including the plurality of channels and at least one channel having, based on the localized source, a different elevation from the plurality of channels; and outputting the second audio signal.

The method may further include: converting each of the audio signals of the plurality of channels into a frequency domain, wherein energy of the audio signals of the plurality of channels converted into the frequency domain and at least one of correlations of the plurality of channels may be compared to estimate the source position of the first audio signal.

In response to the estimated source position existing within a two-dimensional (2D) plane formed by a plurality of speakers outputting the plurality of channels, the source of the first audio signal may be localized toward the 3D position.

The source position existing within the 2D plane formed by the plurality of speakers may be localized toward a surface of a 3D stereoscopic space formed by the plurality of speakers and at least one speaker outputting the at least one channel.

The first audio signal may be converted into the second audio signal by using position information of the plurality of speakers and position information of the at least one speaker.

The plurality of speakers outputting the plurality of channels may be positioned on a plane, and the at least one speaker outputting the at least one channel may be positioned on a plane having a different elevation from the plurality of speakers outputting the plurality of channels.

The converting the first audio signal into the second audio signal may include: in response to a screen of the audio apparatus being higher a position of a head of a listener, moving a central axis of the 3D stereoscopic space by an angle at which the listener looks at a center of the screen, to correct the position information of the plurality of speakers and the position information of the at least one speaker.

The estimating the source position of the first audio signal may include: comparing the energy of the audio signals of the plurality of channels converted into the frequency domain and the at least one of correlations of the plurality of channels to determine a motion of the source position of the first audio signal.

In response to the source of the first audio signal having a motion greater than or equal to a preset value, the source position of the first audio signal may be localized toward the 3D position according to a motion trajectory of the source of the first audio signal.

According to an aspect of another exemplary embodiment, there is provided an audio apparatus including: a receiver which receives a first audio signal including a plurality of channels; a source position estimator which compares audio signals of the plurality of channels to estimate of a source position of the first audio signal; an audio signal converter which localizes a source of the first audio signal toward a 3D position having an elevation component based on the estimated source position and converts the first audio signal into a second audio signal comprising the plurality of channels and at least one channel having, based on the localized source, a different elevation from the plurality of channels; and an output part which outputs the second audio signal.

The audio apparatus may further include: a domain converter which converts the audio signals of the plurality of channels into frequency domains, wherein the source position estimator may compare energy of the audio signals of the plurality of channels converted into the frequency domains and at least one of correlations of the plurality of channels to estimate the source position of the first audio signal.

The output part may include: a plurality of speakers which outputs the audio signals of the plurality of channels, wherein in response to the estimated source position existing within a 2D plane formed by the plurality of speakers, the audio signal converter may localize the source of the first audio signal toward the 3D position.

The output part may further include: at least one speaker which outputs an audio signal of the at least one channel, wherein the audio signal converter may localize the source position existing within the 2D plane formed by the plurality of speakers toward a surface of a 3D stereoscopic space formed by the plurality of speakers and the at least one speaker.

The audio signal converter may convert the first audio signal into the second audio signal by using position information of the plurality of speakers and position information of the at least one speaker.

The plurality of speakers may be positioned on a plane, and the at least one speaker outputting the at least one channel may be positioned on a plane having a different elevation from the plurality of speakers outputting the plurality of channels.

The audio apparatus may further include: a layout parser which stores the position information of the plurality of speakers and the position information of the at least one speaker.

In response to a screen of the audio apparatus being higher than a position of a head of a listener, the layout parser may move a central axis of the 3D stereoscopic space by an angle at which the listener looks at a center of the screen, to correct the position information of the plurality of speakers and the position information of the at least one speaker.

The source position estimator may compare the energy of the audio signals of the plurality of channels converted into the frequency domains and the at least one of correlations of the plurality of channels to determine a motion of the source position of the first audio signal.

In response to the source of the first audio signal having a motion greater than or equal to a preset value, the audio signal converter may localize the source position of the first audio signal toward the 3D position according to a motion trajectory of the source of the first audio signal.

According to an aspect of another exemplary embodiment, there is provided a method of converting an audio signal of an audio apparatus, the method including: localizing a source of a first audio signal including a plurality of channels toward a 3D position having an elevation component based on a source position of the first audio signal; and converting the first audio signal into a second audio signal including the plurality of channels and at least one channel having, based on the localized source, a different elevation from the plurality of channels.

BRIEF DESCRIPTION OF THE DRAWINGS

The above and/or other aspects will be more apparent by describing certain exemplary embodiments with reference to the accompanying drawings, in which.

DETAILED DESCRIPTION OF EXEMPLARY EMBODIMENTS

Figure 1:
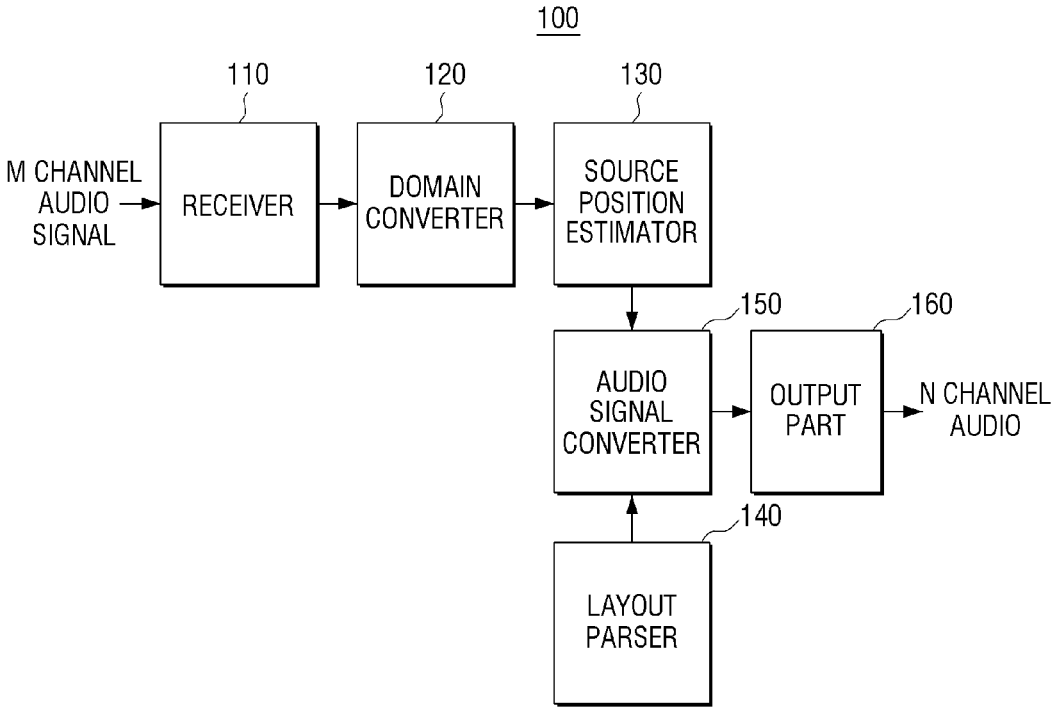
FIG. 1 is a schematic block diagram illustrating a structure of an audio apparatus according to an exemplary embodiment.

Exemplary embodiments are described in greater detail with reference to the accompanying drawings.

In the following description, the same drawing reference numerals are used for the same elements even in different drawings. The matters defined in the description, such as detailed construction and elements, are provided to assist in a comprehensive understanding of exemplary embodiments. Thus, it is apparent that exemplary embodiments can be carried out without those specifically defined matters. Also, well-known functions or constructions are not described in detail since they would obscure exemplary embodiments with unnecessary detail.

FIG. 1 is a schematic block diagram illustrating a structure of an audio apparatus 100 according to an exemplary embodiment.

Referring to FIG. 1, the audio apparatus 100 includes a receiver 110, a domain converter 120, a source position estimator 130, a layout parser 140, an audio signal converter 150, and an output part 160. Here, the audio apparatus 100 may be a home theater but is not limited thereto. Therefore, the audio apparatus 100 may be any type of audio apparatus which outputs a plurality of audio channels.

The receiver 110 receives a first audio signal including a plurality of channels from an external apparatus (e.g., a digital video disk (DVD) apparatus, a Blu-ray disk (BD) apparatus, or the like) or a broadcasting station. Here, the received first audio signal may be an audio signal forming a sound filed on a two-dimensional (2D) plane like a 2.1 channel audio signal or a 5.1 channel audio signal.

The domain converter 120 converts the first audio signal having the plurality of channels into a frequency domain. For example, the domain converter 120 may convert a first audio signal of a time domain into a frequency domain according to each channel by using Fast Fourier Transform (FFT). The domain converter 120 may divide an audio signal of each channel converted into a frequency domain into sub-bands.

The source position estimator 130 compares audio signals of the plurality of channels converted into the frequency domains to estimate, to determine, or to obtain a position of a source of the first audio signal. In detail, the source position estimator 130 detects energy of a sub-band of each channel and calculates a correlation between channels. The source position estimator 130 determines at least two of the plurality of channels having greatest energy. The source position estimator 130 estimates the position of the source by using the at least two channels and the calculated correlation between the channels.

For example, the source position estimator 130 estimates a position of at least one source of each sub-band according to whether the determined at least two channels having the greatest energy are adjacent channels or left and right channels and whether an Inter-channel Cross Correlation (ICC) value is greater or smaller than a threshold value of 0.5.

Figure 2:
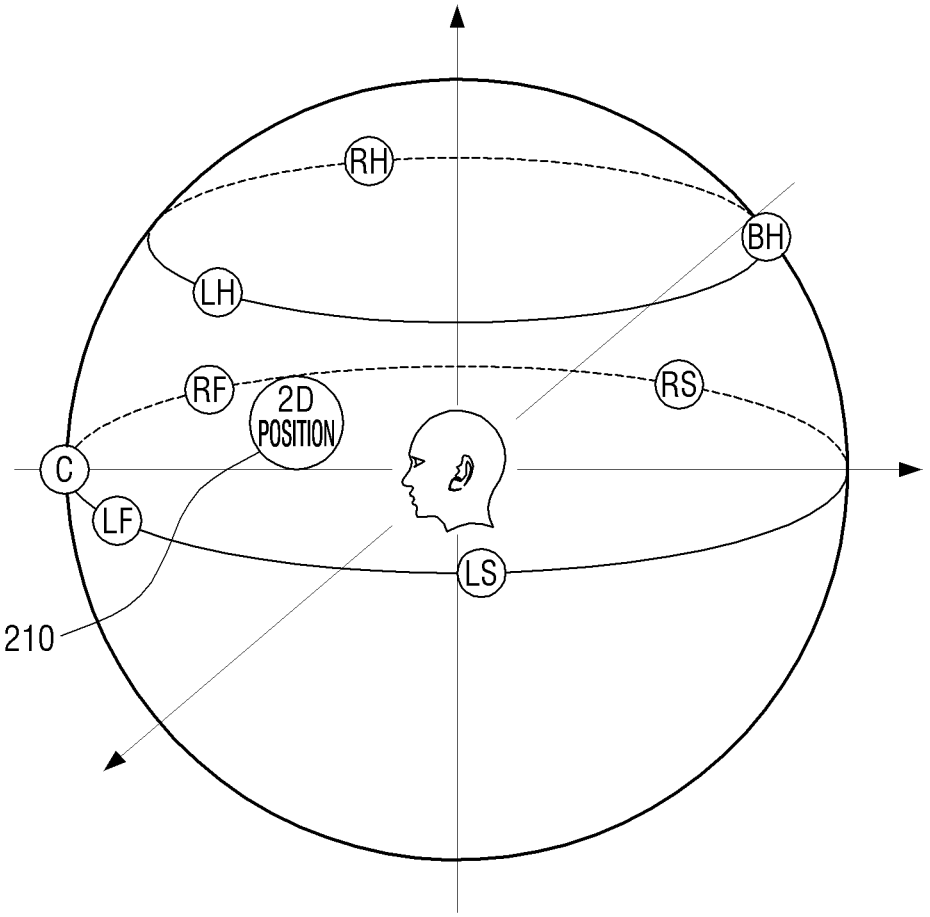
FIGS. 2 through 5 are views illustrating a method of converting an audio signal according to an exemplary embodiment.

Here, the source position estimator 130 estimates a position of a source within a 2D space including speakers respectively outputting channels of an input audio signal. For example, if a 5.1 channel audio signal is input into the receiver 110, speakers (i.e., a center speaker, a front left speaker, a front right speaker, a rear left speaker, and a rear right speaker) for outputting a 5.1 channel audio signal of a 5.1 channel may realize a 2D plane sound field as shown in FIG. 2. The source position estimator 130 estimates a source position 210 on a 2D plane by using at least one of energy of each channel and a correlation between channels.

The layout parser 140 stores position information of a speaker of each channel. In detail, the layout parser 140 stores position information of first speakers for outputting a plurality of channels and position information of second speakers having different altitudes from the speakers and outputs the position information to the audio signal converter 150.

Here, the layout parser 140 moves an axis of a three-dimensional (3D) stereoscopic space formed by the first and second speakers according to a position of a screen to correct positions of the first and second speakers.

Figure 4:
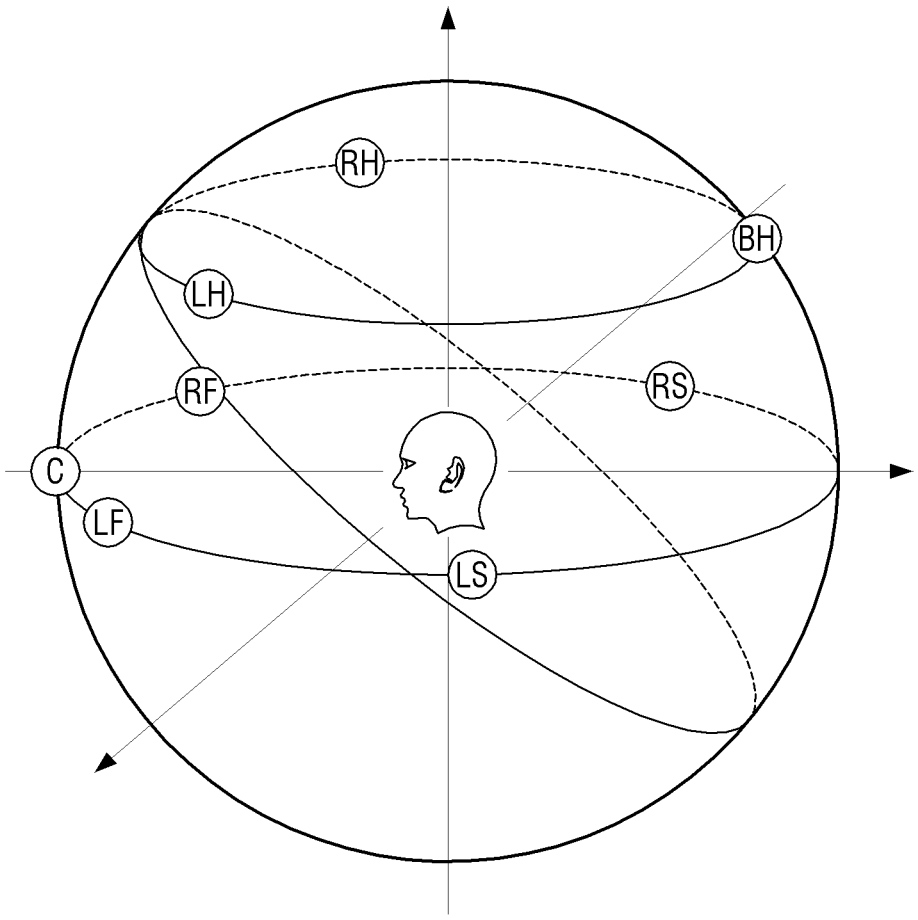
Figure 5:
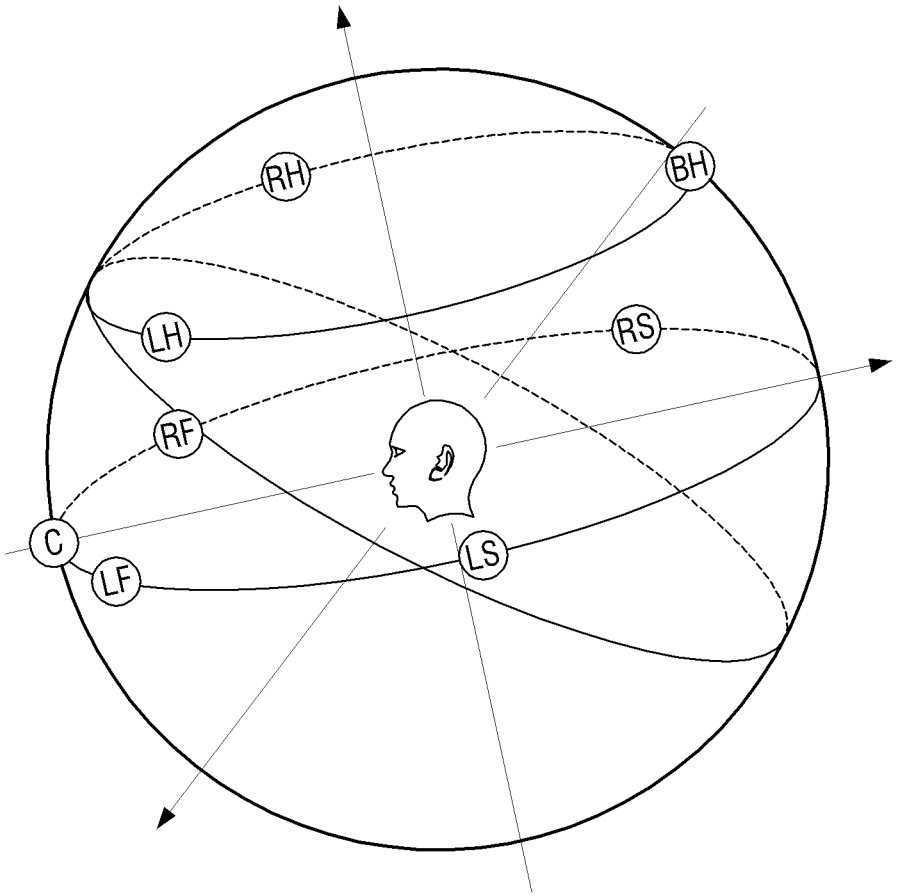

In detail, if the screen is in the same position as eyes of a listener, the position of the screen and positions of ears of the listener are on the same plane. Therefore, the layout parser 140 outputs the position information of the first speakers and the position information of the second speakers to the audio signal converter 150 without changing an axis of a 3D space as shown in FIG. 4. However, if the position of the screen is higher than the eyes of the listener, i.e., the position of the screen is higher than a position of a head of the listener, the layout parser 140 moves a central axis of a 3D stereoscopic space by an angle at which the listener looks at a center of the screen, to correct the position information of the first speakers and the position information of the second speakers as shown in FIG. 5, and outputs the corrected position information of the first and second speakers to the audio signal converter 150. Also, if the position of the screen is lower than the eyes of the listener, i.e., the position of the screen is lower than the position of the head of the listener, the layout parser 140 moves the central axis of the 3D stereoscopic space by an angle at which the listener looks down the center of the screen, to correct the position information of the first and second speakers, and outputs the corrected position information of the first and second speakers to the audio signal converter 150.

The audio signal converter 150 determines the source of the first audio signal in a 3D position having an elevation component based on the source position estimated by the source position estimator 130. The audio signal converter 150 also converts the first audio signal into a second audio signal including a plurality of channels and at least one channel having a different elevation from the plurality of channels based on the position of the source.

Figure 3:
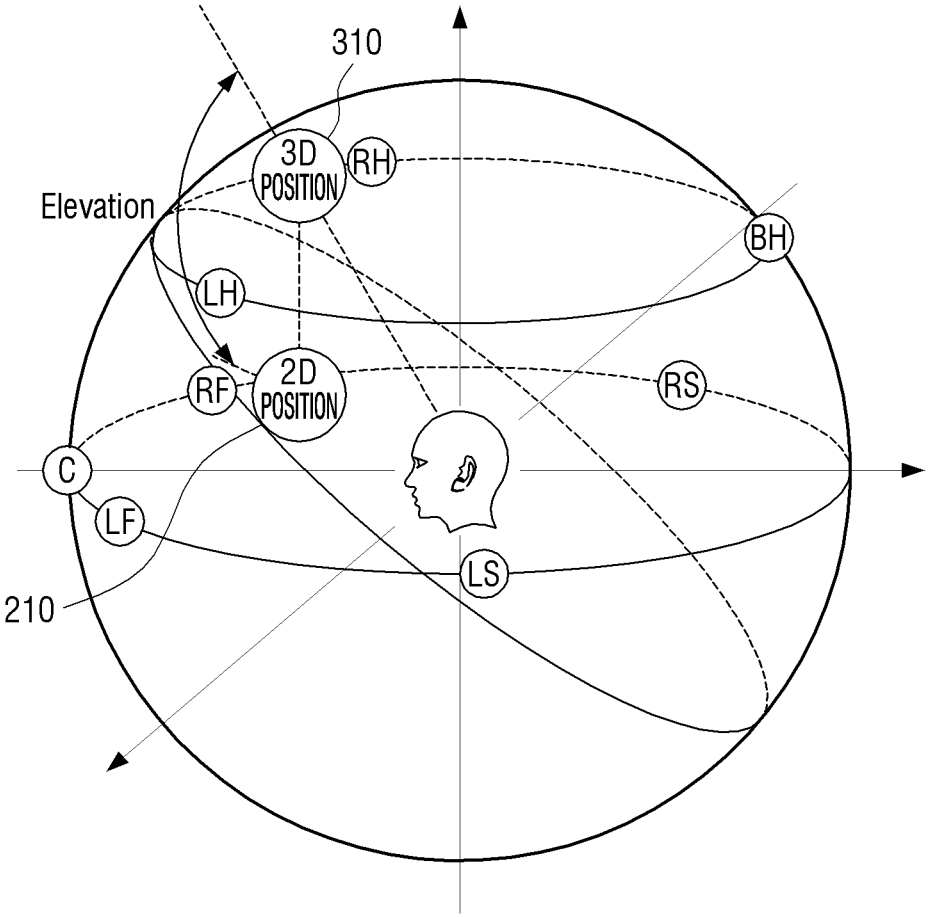

In detail, the audio signal converter 150 determines the position of the source on the 2D plane estimated through the source position estimator 130 onto a surface of the 3D stereoscopic space formed of the first and second speakers. For example, if the source position estimator 130 estimates the position of the source as shown in FIG. 2, the audio signal converter 150 localizes the position of the source on the 2D plane toward the surface of the 3D stereoscopic space as shown in FIG. 3. Here, the audio signal converter 150 assumes that a position of an audio source is projected from a surface of a 3D stereoscopic space onto a 2D plane to localize the source on the 2D plane toward a position 310 of the 3D stereoscopic space having an elevation component.

If the position of the source estimated through the source position estimator 130 is within a 2D plane formed of the first speakers, the audio signal converter 150 localizes the position of the source toward the surface of the 3D stereoscopic space. For example, only if the position of the source exists within a circle formed by speakers, the audio signal converter 150 localizes the position of the source toward the surface of the 3D stereoscopic surface. However, if the position of the source estimated through the source position estimator 130 does not exist within the 2D plane formed by the first speakers, the audio signal converter 150 does not convert a first audio signal having N channels and outputs the first audio signal as it is to the output part 160.

The audio signal converter 150 renders a first audio signal having M channels into a second audio signal having N channels according to the position of the source localized on the surface of the 3D stereoscopic space. Here, the second audio signal includes the M channels of the first audio signal and at least one channel having an elevation component.

In detail, the audio signal converter 150 determines the position of the source localized on the surface of the 3D stereoscopic space to determine at least three speakers closest to the localized position of the source. Here, the at least three speakers may include at least one of the first speakers and at least one of the second speakers to include speakers having different elevations.

The audio signal converter 150 converts audio data of a channel corresponding to at least three speakers closest to the localized position based on the position localized toward the surface of the 3D stereoscopic space. Here, the audio signal converter 150 converts audio data of a channel corresponding to the other speakers other than the at least three speakers closest to the localized position.

For example, if an input audio signal is a 5.1 channel, and speakers closest to a position localized toward a surface of a 3D stereoscopic space are a center speaker, a front right speaker, and a high right speaker, the audio signal converter 150 may convert audio data of a channel of the 5.1 channel corresponding to the center speaker and the front right speaker into audio data of a channel corresponding to the center speaker, the front right speaker, and the high right speaker based on the position localized toward the surface of the 3D stereoscopic space. The audio signal converter 150 may output audio data of the other channels as it is.

In other words, the audio signal converter 150 mixes up a first audio signal including a plurality of channels to be output through a first speaker on a 2D plane with a second audio signal including a plurality of channels to be output through a first speaker on the 2D plane and at least one channel to be output through second speakers having different elevations from the first speakers.

The audio signal converter 150 performs signal-processing, such as sub-band sample summation and Frequency-Time Transform, to output the second audio signal to the output part 160.

The output part 160 outputs a second audio signal including N channels. Here, the output part 160 may include a plurality of speakers disposed on the 2D plane and at least one speaker having a different elevation. For example, the output part 160 includes a center speaker, a front left speaker, a front right speaker, a rear left speaker, a rear right speaker, and a woofer speaker to output a 5.1 channel audio signal on the 2D plane. The output part 160 also includes a high left speaker, a high right speaker, and a high back speaker to output a 3 channel audio signal. However, arrangements of speakers as described above are not limited thereto, and thus speakers may be arranged according to other methods.

A user may be provided with a more stereoscopic audio due to an audio apparatus as described above.

According to another exemplary embodiment, a motion of a source may be determined to convert a 2D audio signal into a 3D stereoscopic audio signal having an elevation component. This will now be described with reference to FIG. 6.

Figure 6:
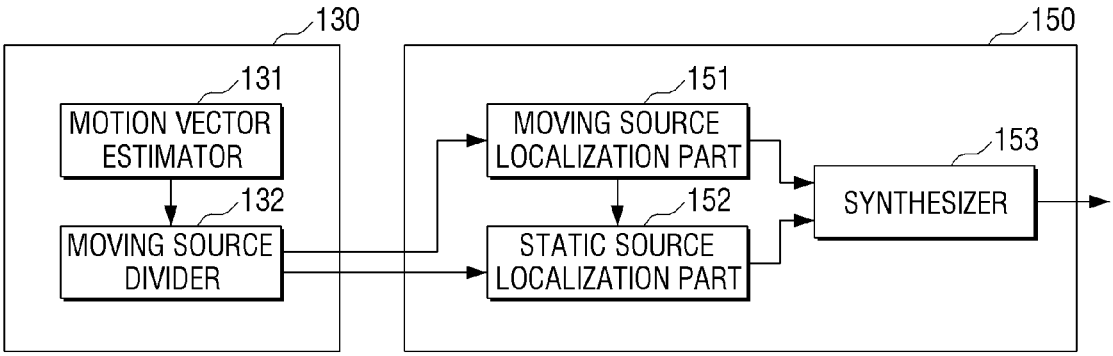
FIG. 6 is a schematic block diagram illustrating a source position estimator and an audio signal converter according to an exemplary embodiment.

As shown in FIG. 6, the source position estimator 130 of the audio apparatus 100 includes a motion vector estimator 131 and a moving source divider 132, and the audio signal converter 150 of the audio apparatus 100 includes a moving source localization part 151, a static source localization part 152, and a synthesizer 153.

The motion vector estimator 131 estimates a motion vector of the source based on the estimated position of the source by using energy of each channel and a correlation between channels.

The moving source divider 132 determines a motion of the source position based on the estimated motion vector of the source. The moving source divider 132 determines a source having a motion greater than or equal to a preset value as a moving source and a source having a motion smaller than the preset value as a static source. The moving source divider 132 outputs the moving source to the moving source localization part 151 and the static source to the static source localization part 152.

Here, a preset value of a motion in left and right directions may be different (e.g., smaller) than a preset value of a motion in front and back directions. In other words, the moving source divider 132 may determine a source having a motion in left and right directions, and not up and down directions, as a moving source.

Figure 7:
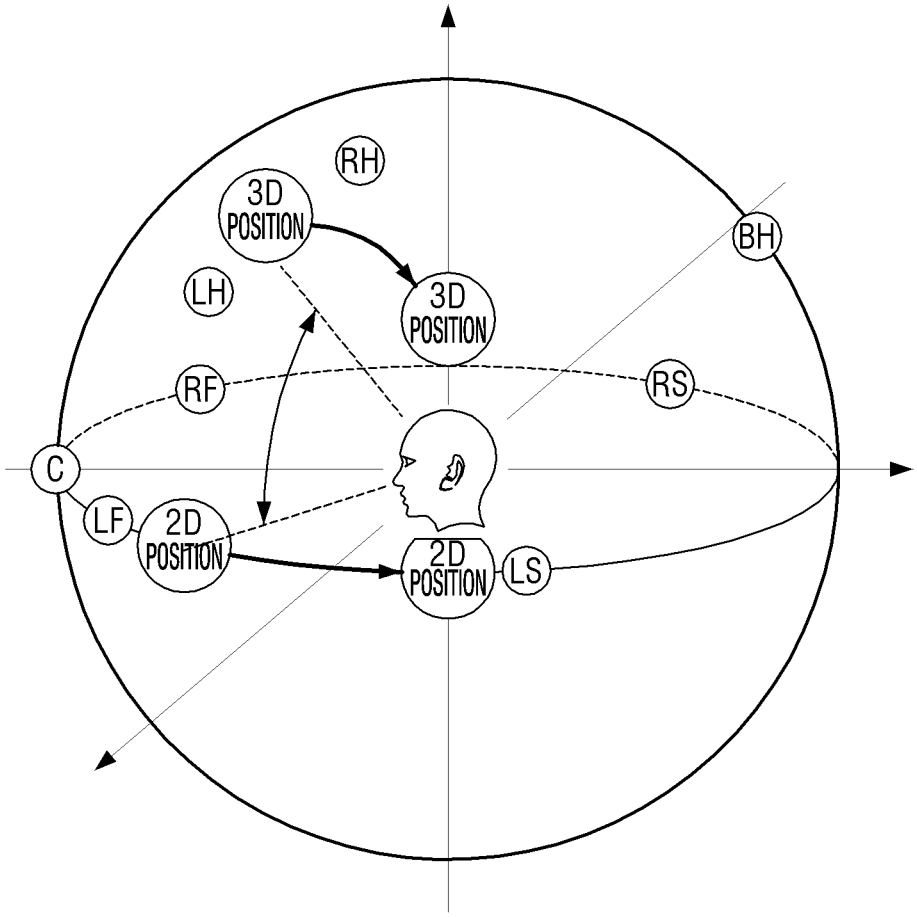
FIG. 7 is a view illustrating a method of converting an audio signal having a moving source according to an exemplary embodiment.

The moving source localization part 151 localizes a position of a moving source of a first audio signal toward a 3D position according to a motion trajectory of the moving source of the first audio signal. As shown in FIG. 7, the moving source localization part 151 tracks a motion path of a source on a 2D plane to localize the source toward a 3D position in order to provide an effect of moving a source on a surface of a 3D stereoscopic space.

The static source localization part 152 localize a static source of the first audio signal on the 2D plane as it is. However, this is only an exemplary embodiment, and it is understood that the static source localization part 152 may localize the static source of the first audio signal on a plane of a 3D stereoscopic space so that the static source has an elevation component, as shown in FIGS. 2 through 5.

The synthesizer 153 synthesizes audio signals respectively output from the moving source localization part 151 and the static source localization part 512 as a second audio signal. Here, the synthesizer 153 performs signal-processing, such as sub-band sample summation and Frequency-Time Transform, with respect to the second audio signal and outputs the second audio signal to the output part 160.

As described above, an elevation component may be added to a moving source to localize the moving source on a surface of a 3D stereoscopic space. Therefore, a user may reorganize an audio signal having a 2D sound field as a 3D sound field having a more grand, splendid effect.

Figure 8:
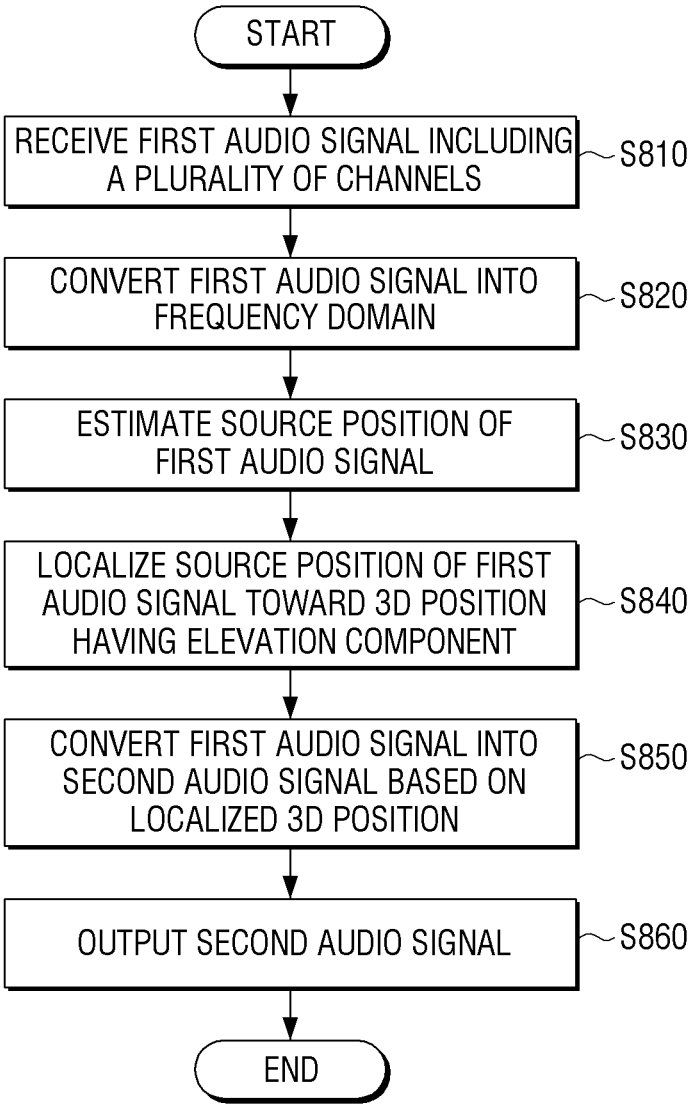
FIG. 8 is a flowchart illustrating a method of converting an audio signal according to an exemplary embodiment.

A method of converting an audio signal of an audio apparatus will now be described in detail with reference to FIG. 8.

In operation S810, the audio apparatus 100 receives a first audio signal including a plurality of channels. Here, the first audio signal may be an audio signal having a sound field on a 2D plane like a 2.1 channel audio signal or a 5.1 channel audio signal.

In operation S820, the audio apparatus 100 converts the first audio signal into a frequency domain. Here, the audio apparatus 100 may convert each audio data of a plurality of channels of the first audio signal into a frequency domain.

In operation S830, the audio apparatus 100 estimates a source position of the first audio signal. In detail, the audio apparatus 100 may estimate the source position of the first audio signal by using energy of each of the channels of the first audio signal converted into the frequency domain and a correlation between the channels. Here, the estimated source position of the first audio signal may exist on the 2D plane.

In operation S840, the audio apparatus 100 localizes the source position of the first audio signal toward a 3D position having an elevation component. In detail, the audio apparatus 100 may localize the source position existing on the 2D plane toward a surface of a 3D stereoscopic space formed by speakers of the audio apparatus 100, so that the source position has an elevation component. Here, the audio apparatus 100 may localize the source position toward a 3D position only if the source position exists within a plane formed by the speakers for outputting a 2D channel.

In operation S850, the audio apparatus 100 converts the first audio signal into a second audio signal based on the localized 3D position. Here, the second audio signal may include the plurality of channels of the first audio signal and at least one channel having a different elevation from the plurality of channels of the first audio signal.

In operation S860, the audio apparatus 100 outputs the second audio signal.

According to the above-described method of converting the audio signal, a user may be provided with an audio having a more stereoscopic effect.

An audio signal converting method of an audio apparatus according to the above-described various exemplary embodiments may be realized as a program and then provided to the audio apparatus.

There may be provided a non-transitory computer readable medium which stores a program including: receiving a first audio signal including a plurality of channels; comparing the first audio signal of the plurality of channels to estimate a source position of the first audio signal; localizing the source position of the first audio signal toward a 3D position having an elevation component based on the estimated source position; converting the first audio signal into a second audio signal including the plurality of channels and at least one channel having a different elevation from the plurality of channels based on the localized source position; and outputting the second audio signal.

The non-transitory computer readable medium refers to a medium which does not store data for a short time such as a register, a cache memory, a memory, or the like but semi-permanently stores data and is readable by a device. In detail, the above-described applications or programs may be stored and provided on a non-transitory computer readable medium such as a CD, a DVD, a hard disk, a blue-ray disk, a universal serial bus (USB), a memory card, a ROM, or the like. Moreover, it is understood that in exemplary embodiments, one or more units of the above-described apparatus 100 can include circuitry, a processor, a microprocessor, etc., and may execute a computer program stored in a computer-readable medium.

The foregoing exemplary embodiments and advantages are merely exemplary and are not to be construed as limiting. The present teaching can be readily applied to other types of apparatuses. Also, the description of exemplary embodiments is intended to be illustrative, and not to limit the scope of the claims, and many alternatives, modifications, and variations will be apparent to those skilled in the art.

What is claimed is:

1. A method of converting an audio signal of an audio apparatus, the method comprising:

receiving audio signals of a plurality of channels, wherein the audio signals of the plurality of channels form a sound field of a two-dimensional (2D) plane;

estimating a position of a source included in the audio signals of the plurality of channels from the sound field of the 2D plane by comparing the audio signals of the plurality of channels;

determining an elevation component of the source by projecting the position of the source on the sound field of the 2D plane onto a surface of a 3D stereoscopic space;

converting the audio signals of the plurality of channels into output audio signals of a plurality of channels based on the position and the elevation component of the source, wherein at least one channel among the output audio signals is an elevation channel; and outputting the output audio signals.

2. The method of claim 1, further comprising:

converting each of the audio signals of the plurality of channels into a frequency domain, wherein the estimating the position of the source comprises comparing energy of the audio signals of the plurality of channels converted into the frequency domain and at least one of correlations of the plurality of channels to estimate the position of the source.

3. The method of claim 2, wherein the determining the elevation component of the source comprises, in response to the estimated position of the source existing within a 2D plane formed by a plurality of speakers outputting the plurality of channels, localizing the source toward a three-dimensional (3D) position.

4. The method of claim 3, wherein the localizing in response to the estimated position of the source existing with the 2D plane comprises localizing the position of the source existing within the 2D plane formed by the plurality of speakers toward a surface of a 3D stereoscopic space formed by the plurality of speakers and at least one speaker outputting the at least one channel.

5. The method of claim 4, wherein the converting comprises converting the audio signals of the plurality of channels into the output audio signals based on position information of the plurality of speakers and position information of the at least one speaker.

6. The method of claim 5, wherein the plurality of speakers outputting the plurality of channels are positioned on a plane, and the at least one speaker outputting the at least one channel is positioned on a plane having a different elevation from the plurality of speakers outputting the plurality of channels.

7. The method of claim 6, wherein the converting the audio signals of the plurality of channels into the output audio signals based on the position information of the plurality of speakers and the position information of the at least one speaker comprises:

in response to a screen of the audio apparatus being higher than a position of a head of a listener, moving a central axis of the 3D stereoscopic space by an angle at which the listener looks at a center of the screen, to correct the position information of the plurality of speakers and the position information of the at least one speaker.

8. The method of claim 6, wherein the converting the audio signals of the plurality of channels into the output audio signals based on the position information of the plurality of speakers and the position information of the at least one speaker comprises:

in response to a screen of the audio apparatus being lower than a position of a head of a listener, moving a central axis of the 3D stereoscopic space by an angle at which the listener looks down a center of the screen, to correct the position information of the plurality of speakers and the position information of the at least one speaker.

9. The method of claim 6, wherein the converting the audio signals of the plurality of channels into the output audio signals based on the position information of the plurality of speakers and the position information of the at least one speaker comprises:

in response to a screen of the audio apparatus being on a same plane as a position of a head of a listener and not lower than or higher than the head of the listener, converting a first audio signal into a second audio signal based on the position information of the plurality of speakers and the position information of the at least one speaker, without changing the position information of the plurality of speakers and the position information of the at least one speaker.

10. The method of claim 2, wherein the comparing the energy of the audio signals of the plurality of channels comprises:

comparing the energy of the audio signals of the plurality of channels converted into the frequency domain and the at least one of correlations of the plurality of channels to determine a motion of the position of the source.

11. The method of claim 10, wherein the determining the elevation component comprises, in response to the source having a motion greater than or equal to a preset value, localizing the position of the source toward a 3D position according to a motion trajectory of the source.

12. The method of claim 2, wherein the converting the each of the audio signals comprises converting the each of the audio signals of the plurality of channels from a time domain into the frequency domain using Fast Fourier Transform.

13. The method of claim 2, wherein the converting the each of the audio signals comprises dividing, into sub-bands, the each of the audio signals of the plurality of channels converted into the frequency domain.

14. The method of claim 2, wherein the comparing the energy of the plurality of channels comprises determining at least two channels, among the plurality of channels, having a greatest energy and estimating the position of the source based on the determined at least two channels.

15. The method of claim 1, wherein a number of channels of output audio signals is greater than a number of channels of the received audio signals according to the converting.

16. A non-transitory computer readable recording medium having recorded thereon a program executable by a computer for performing the method of claim 1.

17. An audio apparatus comprising:

a receiver which receives audio signals of a plurality of channels, wherein the audio signals of the plurality of channels form a sound field of a two-dimensional (2D) plane;

a source position estimator which estimates a position of a source included in the audio signals of the plurality of channels from the sound field of the 2D plane by comparing the audio signals of the plurality of channels;

an audio signal converter which determines an elevation component of the source by projecting the position of the source on the sound field of the 2D plane onto a surface of a 3D stereoscopic space, and converts the audio signals of the plurality of channels into output audio signals of a plurality of channels based on the position and the elevation component of the source, wherein at least one channel among the output audio signals is an elevation channel; and an output part which outputs the output audio signals.

18. The audio apparatus of claim 17, further comprising:

a domain converter which converts the audio signals of the plurality of channels into frequency domains, wherein the source position estimator compares energy of the plurality of channels converted into the frequency domains and at least one of correlations of the plurality of channels to estimate the position of the source.

19. The audio apparatus of claim 18, wherein the output part comprises:

a plurality of speakers which outputs the plurality of channels, wherein in response to the estimated position of the source existing within a 2D plane formed by the plurality of speakers, the audio signal converter localizes the source toward a three-dimensional (3D) position.

20. The audio apparatus of claim 19, wherein the output part further comprises:

at least one speaker which outputs the at least one channel, wherein the audio signal converter localizes the position of the source existing within the 2D plane formed by the plurality of speakers toward a surface of a 3D stereoscopic space formed by the plurality of speakers and the at least one speaker.

21. The audio apparatus of claim 20, wherein the audio signal converter converts the audio signals of the plurality of channels into the output audio signals based on position information of the plurality of speakers and position information of the at least one speaker.

22. The audio apparatus of claim 21, wherein the plurality of speakers are positioned on a plane, and the at least one speaker outputting the at least one channel is positioned on a plane having a different elevation from the plurality of speakers outputting the plurality of channels.

23. The audio apparatus of claim 22, further comprising:

a layout parser which stores the position information of the plurality of speakers and the position information of the at least one speaker.

24. The audio apparatus of claim 23, wherein in response to a screen of the audio apparatus being higher than a position of a head of a listener, the layout parser moves a central axis of the 3D stereoscopic space by an angle at which the listener looks at a center of the screen, to correct the position information of the plurality of speakers and the position information of the at least one speaker.

25. The audio apparatus of claim 24, wherein in response to the source having a motion greater than or equal to a preset value, the audio signal converter localizes the position of the source toward a 3D position according to a motion trajectory of the source.

26. The audio apparatus of claim 18, wherein the source position estimator compares the energy of the audio signals of the plurality of channels converted into the frequency domains and the at least one of correlations of the plurality of channels to determine a motion of the position of the source.

27. A method of converting an audio signal of an audio apparatus, the method comprising:

determining an elevation component of a source by projecting a position of the source on a sound field of a two-dimensional (2D) plane onto a surface of a three-dimensional (3D) stereoscopic space, the source included in audio signals of a plurality of channels that form the sound field of the 2D plane; and converting the audio signals of the plurality of channels into output audio signals of a plurality of channels based on the position and the elevation component of the source, wherein at least one channel among the output audio signals is an elevation channel.

28. The method of claim 27, wherein the determining the elevation component of the source comprises, in response to the position of the source existing within a 2D plane formed by a plurality of speakers outputting the plurality of channels, localizing the source toward a three-dimensional (3D) position.

29. The method of claim 28, wherein the localizing in response to the position of the source existing with the 2D plane comprises localizing the position of the source existing within the 2D plane formed by the plurality of speakers toward a surface of the 3D stereoscopic space formed by the plurality of speakers and at least one speaker outputting the at least one channel.

30. The method of claim 29, wherein the converting the audio signals of the plurality of channels into the output audio signals comprises converting the audio signals of the plurality of channels into the output audio signals based on position information of the plurality of speakers and position information of the at least one speaker.

31. The method of claim 30, wherein the plurality of speakers outputting the plurality of channels are positioned on a plane, and the at least one speaker outputting the at least one channel is positioned on a plane having a different elevation from the plurality of speakers outputting the plurality of channels.

32. The method of claim 31, wherein the converting the audio signals of the plurality of channels into the output audio signals based on the position information of the plurality of speakers and the position information of the at least one speaker comprises:

in response to a screen of the audio apparatus being higher than a position of a head of a listener, moving a central axis of the 3D stereoscopic space by an angle at which the listener looks at a center of the screen, to correct the position information of the plurality of speakers and the position information of the at least one speaker;

in response to the screen of the audio apparatus being lower than the position of the head of the listener, moving the central axis of the 3D stereoscopic space by an angle at which the listener looks down the center of the screen, to correct the position information of the plurality of speakers and the position information of the at least one speaker; and in response to the screen of the audio apparatus being on a same plane as the position of the head of the listener and not lower than or higher than the head of the listener, converting a first audio signal into a second audio signal based on the position information of the plurality of speakers and the position information of the at least one speaker, without changing the position information of the plurality of speakers and the position information of the at least one speaker.

33. The method of claim 27, wherein the determining the elevation component comprises, in response to the source having a motion greater than or equal to a preset value, localizing the position of the source toward a 3D position according to a motion trajectory of the source.

34. A non-transitory computer readable recording medium having recorded thereon a program executable by a computer for performing the method of claim 27.

* * * * *